US007318407B1

(12) United States Patent
Klonis et al.

(10) Patent No.: US 7,318,407 B1
(45) Date of Patent: Jan. 15, 2008

(54) GOVERNOR WITH LOW DROOP HAVING OPPOSED SPRING

(75) Inventors: George P. Klonis, New Berlin, WI (US); James J. Dehn, Brookfield, WI (US)

(73) Assignee: Briggs & Stratton Corporation, Wauwatosa, WI (US)

( * ) Notice: Subject to any disclaimer, the term of this patent is extended or adjusted under 35 U.S.C. 154(b) by 0 days.

(21) Appl. No.: 11/649,660

(22) Filed: Jan. 4, 2007

(51) Int. Cl.
*F02D 31/00* (2006.01)

(52) U.S. Cl. ..... 123/376; 123/363

(58) Field of Classification Search ..... 123/376, 123/363

See application file for complete search history.

(56) References Cited

U.S. PATENT DOCUMENTS

| | | | | |
|---|---|---|---|---|
| 2,529,243 | A | 11/1950 | Brown et al. | |
| 2,815,739 | A | 12/1957 | Holl | |
| 2,836,159 | A | 5/1958 | Morden | |
| 3,276,439 | A | 10/1966 | Reichenbach | |
| 4,773,371 | A | 9/1988 | Stenz | |
| 4,836,167 | A * | 6/1989 | Huffman et al. | 123/376 |
| 5,235,943 | A * | 8/1993 | Fiorenza, II | 123/179.18 |
| 5,503,125 | A | 4/1996 | Gund | |
| 6,598,586 | B2 * | 7/2003 | Deschamps et al. | 123/376 |
| 6,983,736 | B2 * | 1/2006 | Mitchell et al. | 123/376 |
| 7,097,163 | B2 * | 8/2006 | Moriyama et al. | 261/52 |
| 7,246,794 | B2 * | 7/2007 | Suzuki et al. | 261/52 |
| 2004/0112333 | A1 | 6/2004 | Mitchell et al. | |
| 2006/0130808 | A1 * | 6/2006 | Steffes et al. | 123/376 |

* cited by examiner

*Primary Examiner*—Erick Solis
(74) *Attorney, Agent, or Firm*—Michael Best & Friedrich LLP

(57) ABSTRACT

A governor for an engine including a speed sensor, a throttle member, a linkage, a primary spring, and a secondary spring. The speed sensor moves in response to changes in a speed of the engine. The linkage is coupled between the speed sensor and the throttle member to move the throttle member between a first position and a second position in response to the speed of the engine. The primary spring directly couples the throttle member to the engine to bias the throttle member in a first direction, and the secondary spring directly couples the throttle member to the engine to bias the throttle member in a second direction at least partially opposite to the first direction.

22 Claims, 8 Drawing Sheets

GOVERNOR WITH LOW DROOP HAVING OPPOSED SPRING

BACKGROUND

The present invention relates to a governor for an internal combustion engine, and more particularly to a mechanical governor with low temporary droop for a small engine.

Governors are generally used to regulate and stabilize the speed of internal combustion engines. The mechanical governor generally receives an input indicative of an engine speed and moves an engine throttle to adjust the engine speed. A governor spring affects movement of the throttle such that the governed speed of the engine is determined by the interplay between the movement of the governor speed sensor and the spring force of the governor spring. Typically, the speed sensor causes a non-linear speed sensor force, whereas the governor spring is defined by a substantially constant force. Therefore, the governor spring only substantially counteracts the force of the speed sensor over a very limited range, resulting in an unstable governor in some circumstances.

A typical governor provides continuous adjustment to a throttle or other control member in an effort to maintain a constant engine speed. Droop of a governor allows engine speed to drop when a load is applied to the engine. The amount of droop is a characteristic of a particular mechanical governor, and is determined in part by a spring rate of the governor spring and the tension applied to the control member by the governor spring. Reducing the speed droop by lowering the spring rate of the governor spring may cause the governor to be overly sensitive to small changes in engine load, thus resulting in a less stable engine control. On the other hand, increasing the spring rate makes the governor spring stiffer and more resistant to small changes in engine load, thus making engine reaction sluggish.

In many internal combustion engines, adjusting the engine speed may result in engine hunting or over-compensation. Hunting occurs when the engine overshoots or undershoots the desired speed and is unable to quickly settle at the desired speed. Hunting can be caused by many factors, including the use of springs having light spring rates, sticking or binding between movable parts of the engine and the governor, and the like.

SUMMARY

In one embodiment, the invention provides a mechanical governor for an engine that includes a speed sensor coupled to the engine that moves in response to changes in speed of the engine. The governor further includes a throttle member, a linkage, a primary spring, and a secondary spring. The linkage couples the speed sensor and the throttle member to move the throttle member between a first position and a second position in response to the speed of the engine. The primary spring is connected between the throttle member and a first fixed portion of the engine to bias the throttle member in a first direction, and the secondary spring is connected between the throttle member and a second fixed portion of the engine to bias the throttle member in a second direction that is at least partially opposite to the first direction.

In another embodiment, the invention provides an internal combustion engine that includes a cylinder, and a piston disposed within the cylinder that is reciprocal in response to combustion of a fuel in a combustion chamber. The engine further includes a crankshaft coupled to the piston that rotates in response to the reciprocation of the piston, and a speed sensor coupled to the crankshaft. The speed sensor generates a signal related to the rotational speed of the crankshaft. A throttle member moves between a first position and a second position in response to the signal. A primary spring has a primary spring rate and is coupled to the throttle member to bias the throttle member in a first direction. A secondary spring defines a secondary spring rate that is less than the primary spring rate. The secondary spring couples to the throttle member to bias the throttle member in a second direction that is at least partially opposite to the first direction.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
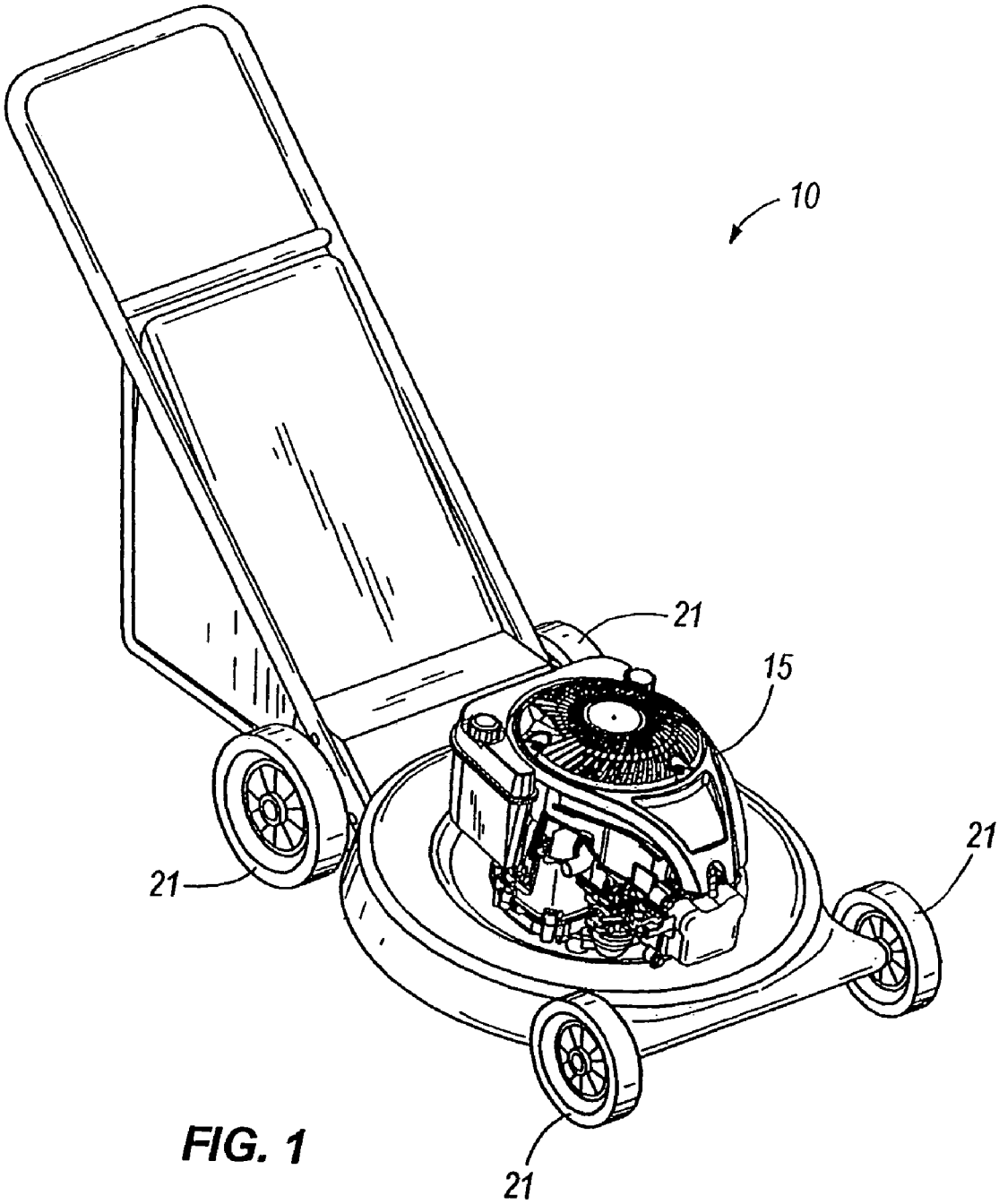
FIG. 1 is a perspective view of a lawnmower including an internal combustion engine.
Figure 2:
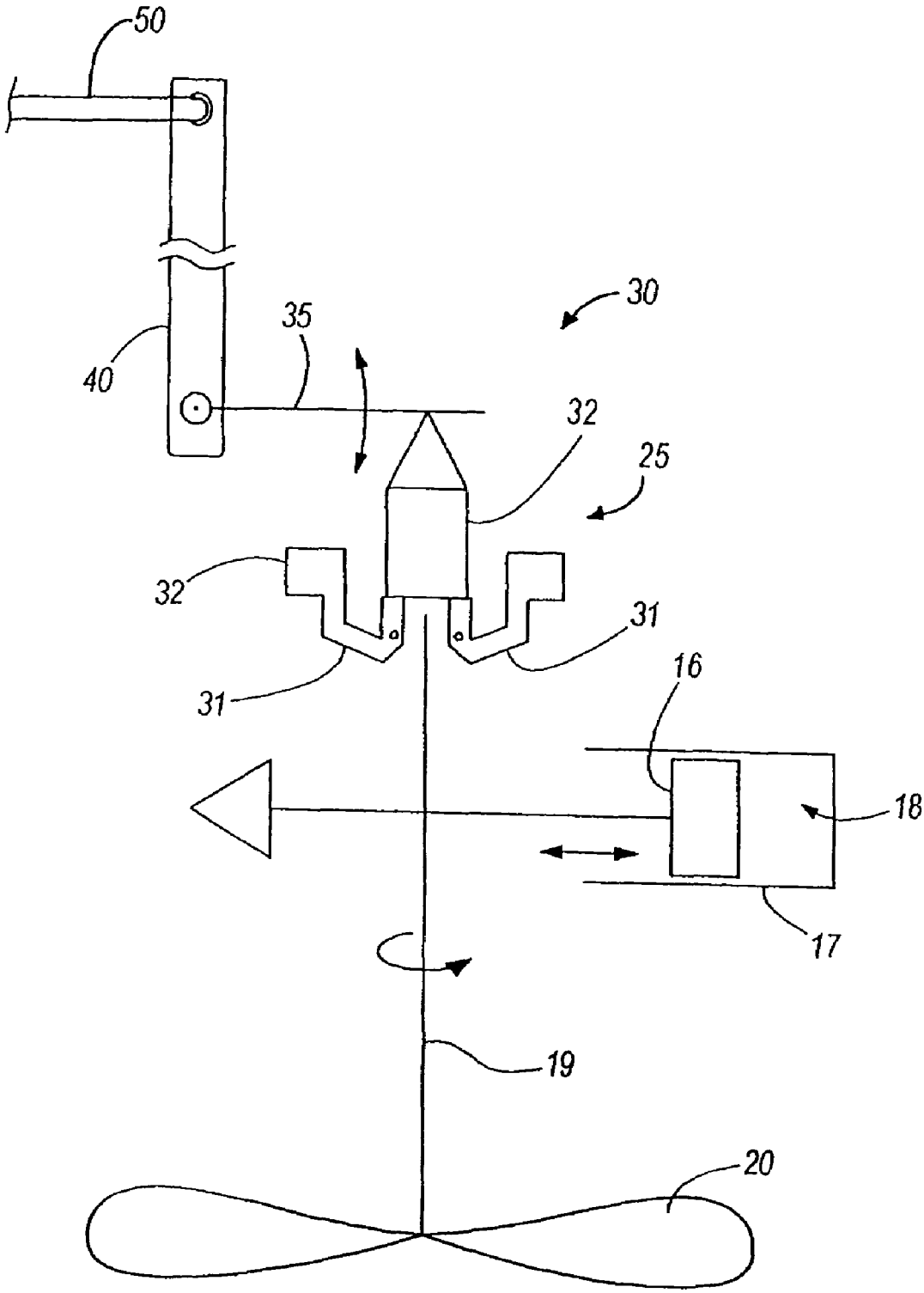
FIG. 2 is a schematic view of a portion of the engine of FIG. 1.

FIG. 1 illustrates a lawn mower 10 that includes a small engine 15. As shown in FIG. 2, the engine 15 includes a piston 16 that reciprocates within a cylinder 17 in response to combustion of an air-fuel mixture within a combustion chamber 18. The reciprocation of the piston 16 produces a corresponding rotation of a crankshaft 19, which in turn rotates a mower blade 20, or rotates another device (e.g., the rotor of a motor or alternator, a pump shaft, or a snow blower auger, etc.). In some arrangements, the rotating crankshaft 19 also provides power to one or more wheels 21 to propel the lawn mower 10 (see FIG. 1).

Before proceeding, it should be noted that the term "small engine" as used herein generally refers to an internal combustion engine that includes one or two cylinders. The engine can be arranged with a horizontal or a vertical crankshaft as may be required. While the invention discussed herein is particularly suited for use with small engines, one of ordinary skill in the art will realize that it could be applied to larger engines (i.e., three or more cylinders) as well as other engine designs (e.g., rotary engine, radial engine, diesel engines, combustion turbines, and the like) which use a mechanical governor. As such, the invention should not be limited to the small engine application described herein.

As schematically illustrated in FIG. 2, the engine 15 further includes a mechanical governor 30 having a speed sensor 25. The speed sensor 25 may be driven by a gear (e.g., a cam gear, timing gear, idler gear, etc.) that rotates with the crankshaft 19. The speed sensor 25 is configured to generate a signal that is related to the rotational speed of the crankshaft 19, typically one-half of the crankshaft speed. The signal can be a mechanical or positional signal, or alternatively an electrical signal (e.g., frequency, pulse, current, voltage, etc.) that is indicative of the rotational speed of the crankshaft 19.

In the embodiment shown in FIG. 2, the speed sensor 25 includes centrifugally-responsive flyweights 31 that engage a plunger 32, which in turn engages a governor shaft 35 to move a governor arm 40 of the governor 30. The plunger 32 moves in response to movement of the flyweights 31 between a first position and a second position based on a rotational speed of the crankshaft 19. In other embodiments, the engine 15 may include a governor air vane adjacent a flywheel fan of the engine 15. Airflow generated by the flywheel fan displaces the air vane to generate the signal. Other governors may include electrical speed sensors, such as magnetic pick-ups or Hall sensors that generate an electrical signal indicative of engine speed when passed by a flywheel magnet.

Figure 3:
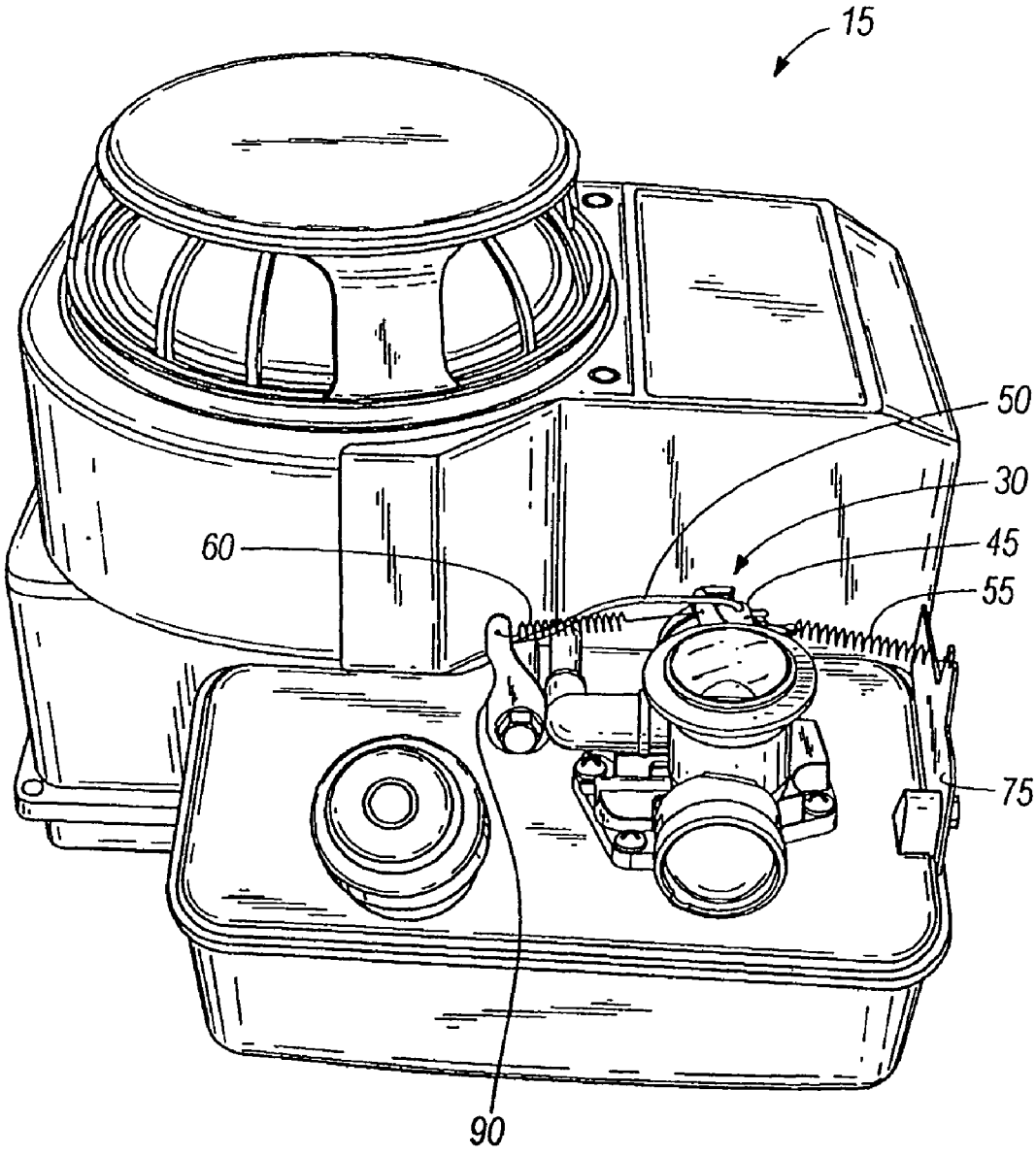
FIG. 3 is a perspective view of a portion of the governor for the engine of FIG. 1.
Figure 4:
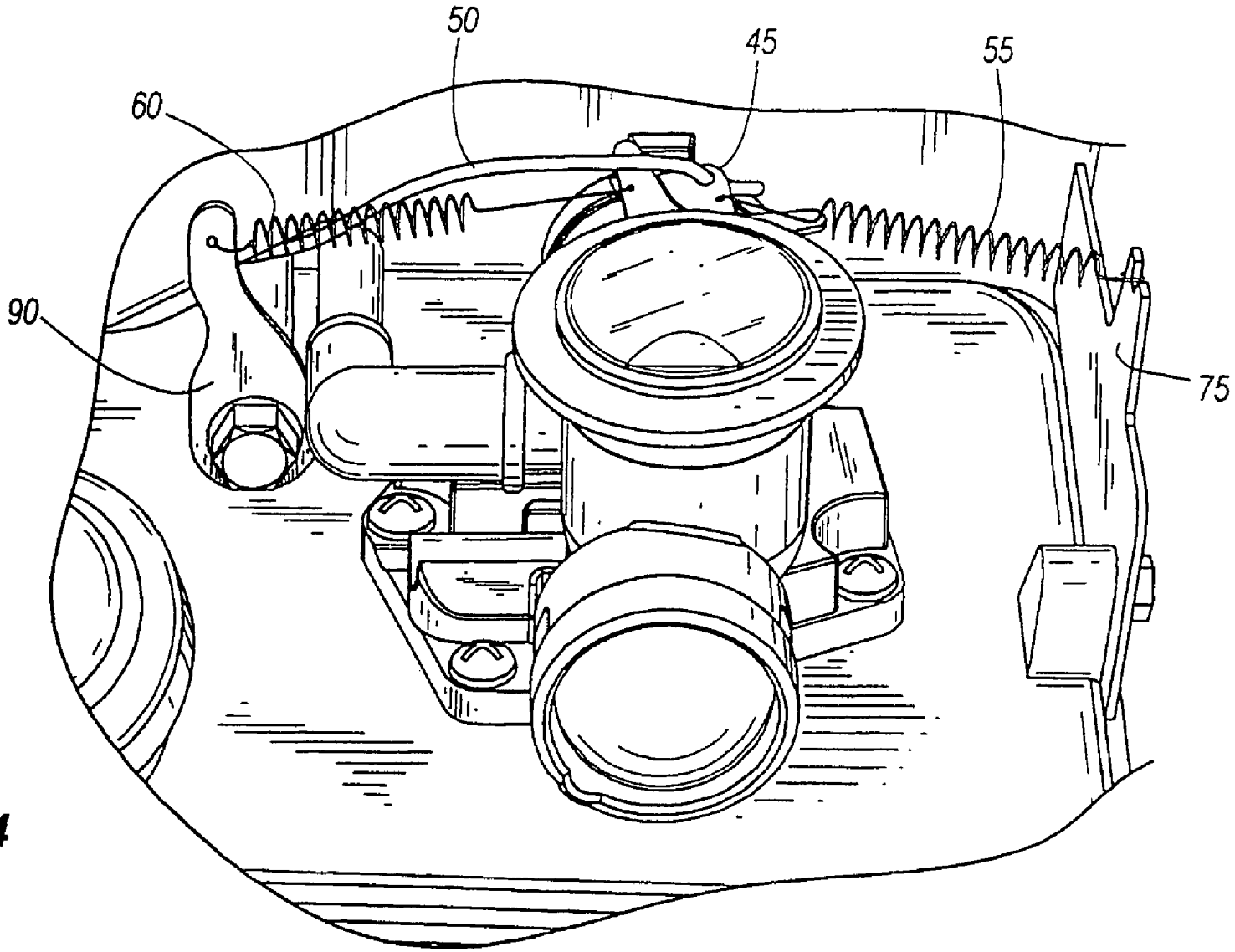
FIG. 4 is an enlarged perspective view of the governor components of FIG. 3.

FIG. 3 shows the engine 15 that further includes a throttle lever 45 positioned adjacent an intake passageway 61 (FIG. 5) and movable between a first position and a second position to vary the flow of the air-fuel mixture through the passageway 61 to the combustion chamber 18 (FIG. 2). The first position and the second position may be any distinct positions of the throttle lever 45. In one embodiment, the first position defines an open position (i.e., wide-open throttle) and the second position defines a substantially closed position. However, other embodiments may define the first and second positions as any distinct positions between open and closed positions.

As shown in FIGS. 2-5, the governor 30 further includes a linkage 50, a primary spring 55, and a secondary spring 60. As shown in FIG. 2, a first end of the linkage 50 is coupled to an upper portion of the governor arm 40. As shown in FIG. 3, a second end of the linkage 50 is attached to the throttle lever 45.

Figure 5:
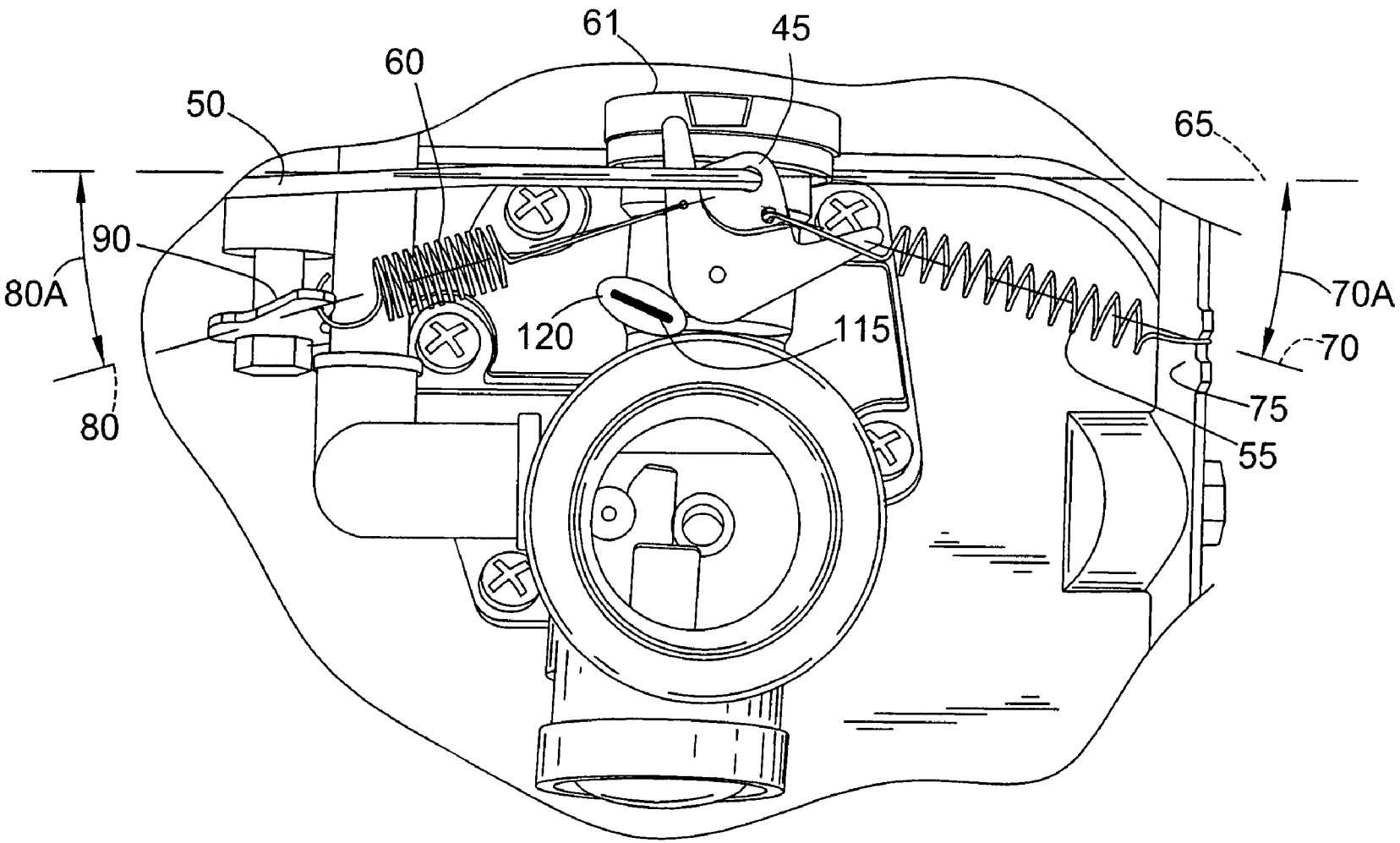
FIG. 5 is a top view of the governor components of FIG. 3 with a throttle in a first position.
Figure 6:
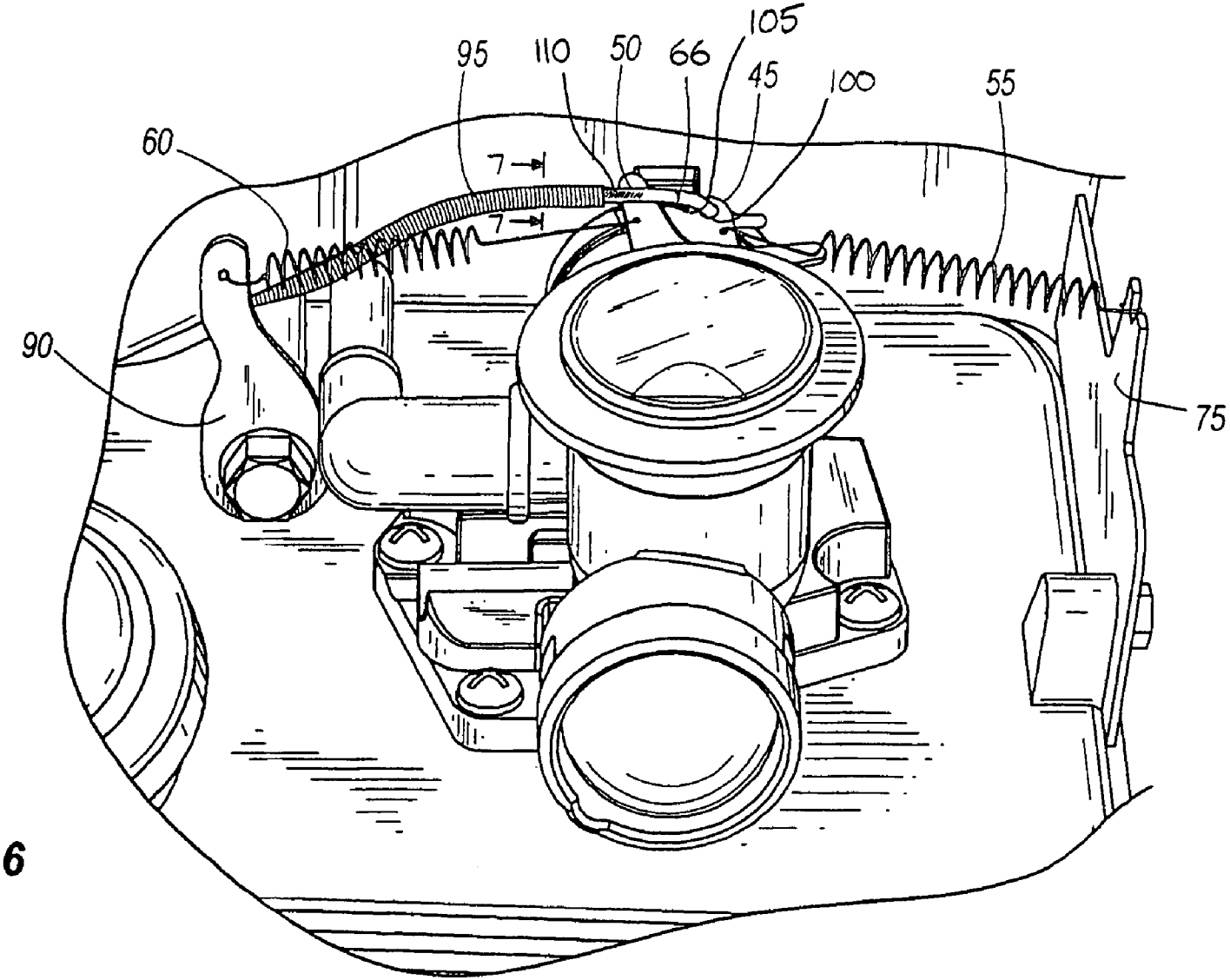
FIG. 6 is an enlarged perspective view of another embodiment of a governor for the engine of FIG. 1.
Figure 7:
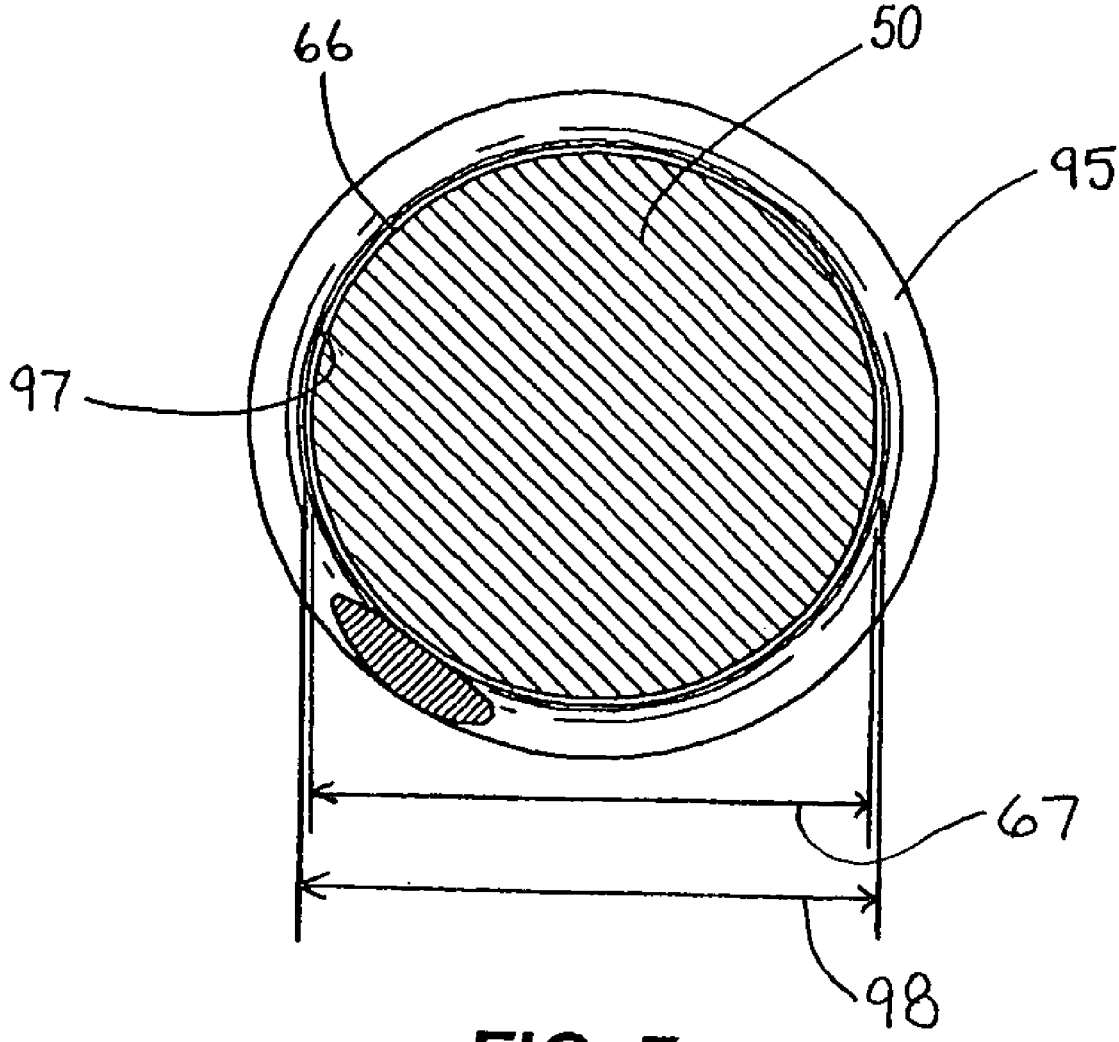
FIG. 7 is a section view of a linkage and a tertiary spring of the governor of FIG. 6, taken along line 7-7.

FIGS. 5-8 show the linkage 50 that defines a first axis 65, and includes a circumferential arc 66 having a diameter 67 (FIG. 7). The linkage 50 is a substantially rigid member that is coupled to the governor arm 40 and the throttle lever 45 to move the throttle lever 45 between the first position and the second position in response to the signal from the speed sensor 25. In other constructions, a multi-piece linkage is employed to interconnect the governor arm 40 and the throttle lever 45.

The primary spring 55 has a second axis 70 and a primary spring rate. In one embodiment, the first axis 65 and the second axis 70 define an angle 70A that is less than about 20 degrees (see FIG. 5). In some embodiments, the second axis 70 is parallel to the first axis 65. In other embodiments, the first axis 65 and the second axis 70 may define the angle 70A between about 20 degrees and 75 degrees. A first end of the primary spring 55 is attached to the throttle lever 45 and a second end of the primary spring 55 is attached to a fixed member 75 that is rigidly attached to a fixed portion of the engine 15.

The primary spring 55 produces a primary force that is at least partially related to a free length of the primary spring 55 and the primary spring rate. The primary force is substantially linear, and biases the throttle lever 45 in a first direction away from the governor arm 40. The first direction extends along the second axis 70. In embodiments that include the first axis 65 and the second axis 70 in parallel, the primary force extends parallel to the first axis 65. In embodiments that include the first axis 65 and the second axis 70 in non-parallel relationship, the primary force includes a first force component that extends parallel to the first axis 65 and in the first direction, and a second force component that extends orthogonal to the first axis 65.

The secondary spring 60 has a third axis 80 and a secondary spring rate. In one embodiment, the first axis 65 and the third axis 80 define an angle 80A that is less than about 20 degrees (see FIG. 5). In other embodiments, the third axis 80 is parallel to the first axis 65. In still other embodiments, the first axis 65 and the third axis 80 may define the angle 80A between about 20 degrees and 75 degrees.

As shown in FIGS. 3-6, a first end of the secondary spring 60 is attached to the throttle lever 45 and a second end of the secondary spring is attached to a fixed member 90 that is rigidly attached to a fixed portion of the engine 15. The secondary spring 60 is spaced apart from the linkage 50 so that the secondary spring 60 does not frictionally engage the linkage 50, or otherwise contact the linkage 50 (FIG. 5). In some embodiments, the fixed portion of the engine 15 that is attached to the fixed member 75 and the fixed portion of the engine 15 that is attached to the fixed member 90 may be defined by different parts of the same portion of the engine 15. In other embodiments, the fixed portion of the engine 15 that is attached to the fixed member 75 and the fixed portion of the engine 15 that is attached to the fixed member 90 may be defined by different portions of the engine 15.

The secondary spring produces a secondary force that is at least partially related to a free length of the secondary spring 60 and the secondary spring rate. The secondary force is substantially linear and extends in a direction along the third axis 80 to bias the throttle lever 45 in a second direction that is at least partially opposite to the primary force. In embodiments arranged such that the first axis 65 and the third axis 80 are parallel, the secondary force extends parallel to the first axis 65 and toward the second direction. In embodiments arranged such that the first axis 65 and the third axis 80 are not parallel, the secondary force includes a third force component that extends parallel to the first axis 65 and toward the second direction, and a fourth force component that is normal to the first axis 65. The third force component that extends parallel to the first axis 65 is further parallel to and opposite the first force component of the primary force. In the illustrated embodiment, the secondary force substantially opposes the primary force of the primary spring 55. In other embodiments, the secondary force may at least partially oppose the primary force.

The secondary spring 60 is chosen such that the secondary spring rate is less than the primary spring rate. In one embodiment, the secondary spring rate is between about 90 percent and 99 percent of the primary spring rate. Other embodiments of the secondary spring 60 may include a secondary spring rate that is between about 50 percent and 99 percent of the primary spring rate.

The primary force, including the first and second force components, cooperates with the secondary force, including the third and fourth force components, to limit droop of the engine 15. Engine droop can be categorized as permanent droop and temporary droop. Permanent droop can be defined as a percentage change in speed of the engine 15 over a full load range (e.g., from no load to full load). For most engines, the initial engine speed is referred to as "speed no-load." Most engines operate at a second speed when a second or full load is applied. The difference between the full load speed and the no-load speed is referred to as permanent droop. For example, one exemplary engine 15 operates at 3000 RPM when no load is applied to the engine 15 and at 2850 RPM when the full design load is applied. In this example, the engine 15 has a permanent droop of 5 percent. In other engines, the governor 30 operates to maintain a uniform engine speed regardless of the load applied to the engine. These engines operate with zero permanent droop.

Temporary droop can be defined as the temporary speed change that occurs immediately after a change in engine load. The amount and duration of the speed error during this load change, or transient period, is defined by the governor 30. The temporary droop of a particular governor is a function of the governor's ability to react to engine load change. The temporary deviation from the governed or desired speed after an engine load change is the temporary droop of the engine 15.

FIG. 6 shows another embodiment of the governor 30 that further includes a tertiary spring 95 in addition to the primary spring 55 and the secondary spring 60. The tertiary spring 95 includes a coil portion, a first end coupled to the governor arm 40, and a second end coupled to the throttle lever 45. The second end of the tertiary spring 95 is spaced a distance apart from the attachment of the linkage 50 to the throttle lever 45. The coil portion defines a tertiary spring rate and an inner circumferential arc 97 having a diameter 98 (FIG. 7).

The tertiary spring 95 is chosen such that the tertiary spring rate is less than the primary spring rate. In one embodiment, the tertiary spring rate is between about 20 percent and 75 percent of the primary spring rate. Other embodiments may include a tertiary spring rate that is lower than 20 percent, or higher than 75 percent of the primary spring rate.

As shown in FIG. 7, the linkage 50 is at least partially disposed within the coil portion of the tertiary spring 95. The coil portion is tightly wound around the linkage 50 such that the diameter 98 of the circumferential arc 97 is substantially equal to the diameter 67 of the circumferential arc 66. As such, the outer surface of linkage 50 is substantially engaged by the inner surface of tertiary spring 95. In other embodiments, the diameter 98 of the circumferential arc 97 can be slightly different than the diameter 67 of the circumferential arc 66 such that the outer surface of linkage 50 is at least partially engaged by the inner surface of tertiary spring 95.

The linkage 50 and the tertiary spring 95 cooperate to define a coefficient of friction to dampen movement of the linkage 50 in response to movement of the governor arm 40. The tertiary spring 95 applies a force vector that is normal to the movement of the linkage 50 such that this normal force vector generates friction between the linkage 50 and the tertiary spring 95 to oppose motion of the linkage 50. The close engagement of the circumferential arc 66 and the inner surface of the tertiary spring 95 on the one hand, and the circumferential arc 97 and the outer surface of the linkage 50 on the other hand at least partially determine a portion of the coefficient of friction between the linkage 50 and the tertiary spring 95.

As shown in FIG. 6, the distance between the attachment point 100 of the linkage 50 to the throttle lever 45 and the attachment point 105 of the second end of the tertiary spring 95 to the throttle lever 45 further determines a portion of the coefficient of friction. For example, increasing the distance between the respective attachment points 100, 105 of the linkage 50 and the second end of the tertiary spring 95 to the throttle lever 45 results in a higher coefficient of friction. Decreasing the distance between the respective attachments points 100, 105 of the linkage 50 and the second end of the tertiary spring 95 to the throttle lever 45 results in a lower coefficient of friction.

In some embodiments, the linkage 50 includes a friction enhancing surface 110 (e.g., a roughened surface, a scored surface, etc.) to increase friction between the linkage 50 and the tertiary spring 95. The friction enhancing surface 110 (FIG. 6) defines a coefficient of friction between the linkage 50 and the tertiary spring 95 that is greater than the coefficient of friction between other portions of the linkage 50 and the tertiary spring 95. In other embodiments, a friction enhancing surface may be disposed on the tertiary spring 95. In still other embodiments, the friction enhancing surface may be disposed on both the linkage 50 and the tertiary spring 95. The friction enhancing surface 110 provides additional dampening of the movement of the throttle lever 45 between the first and second positions. As the linkage 50 moves in response to the governor arm 40 and pivots the throttle lever 45, the corresponding coefficient of friction induces resistance to the movement of the linkage 50.

Figure 8:
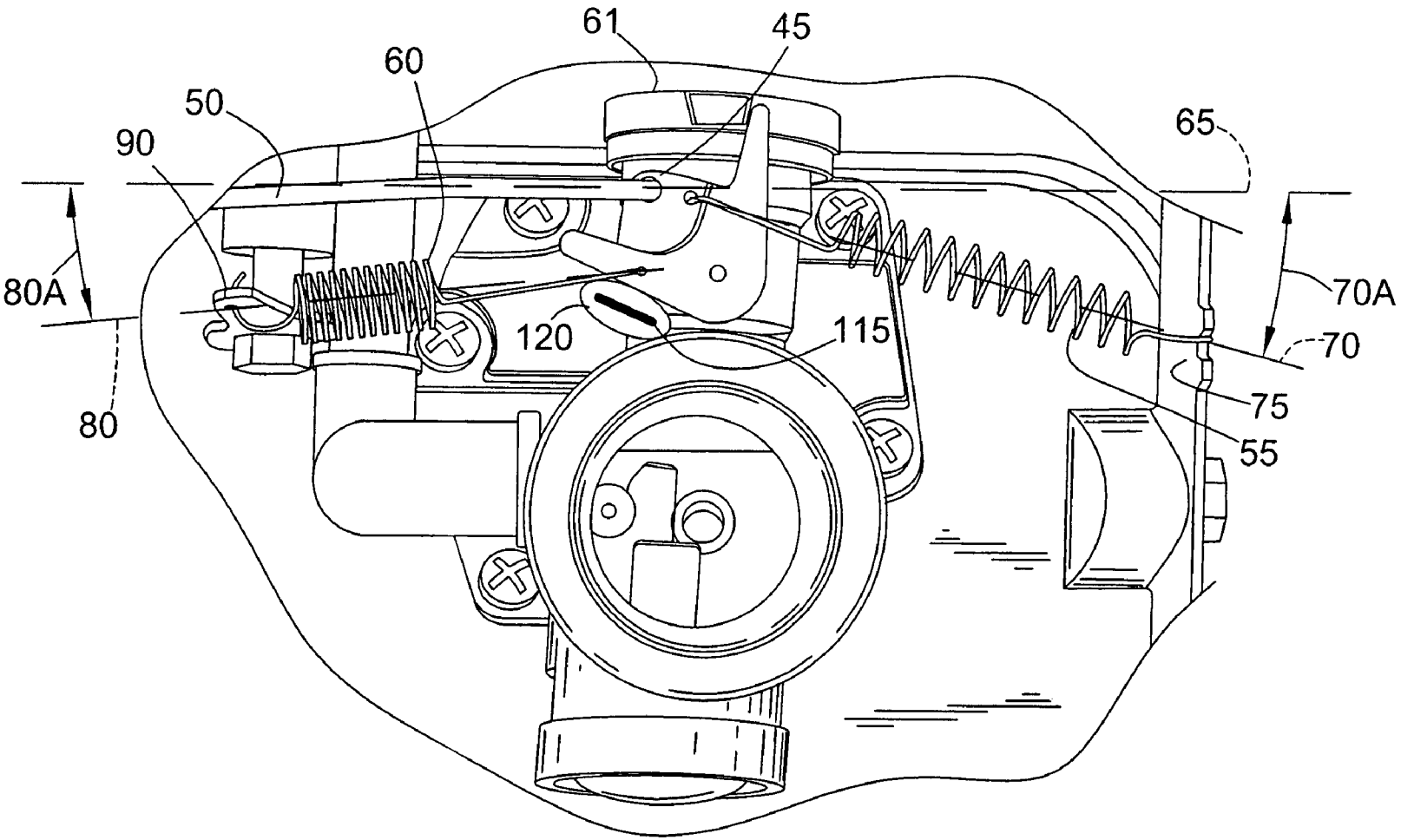
FIG. 8 is a top view of the governor components of FIG. 3 with the throttle in a second position.

FIGS. 5 and 8 illustrate another feature that may be employed in the constructions discussed herein. A projection 115 extends from the engine 15 and provides a receiving space for a dampening member 120. The illustrated projection 115 is a flat component that defines a long axis. The projection 115 is positioned such that the long axis is substantially parallel to the throttle lever 45 when the throttle lever 45 is in the second or idle position. In a preferred arrangement, the projection 115 includes an enlarged top portion that acts to retain the dampening member 120 in the desired position. Of course, other shapes and arrangements could be employed to retain the dampening member 120 if desired.

The damping member 120 is formed from a resilient material such as foam, rubber, cork, etc. The resilient member 120 engages the throttle lever 45 when the throttle lever 45 is in the idle position (FIG. 8). The dampening member 120 forms a substantially oval shape when positioned on the projection 115 with the long side being disposed adjacent the throttle lever 45. When in contact with the throttle lever 45, the dampening member 120 acts to absorb vibrations and small movements that may occur and that may cause uneven engine operation. Thus, the dampening member 120 further stabilizes engine operation when the throttle lever 45 is in the second position.

In operation, the engine 15 operates at a desired speed that may depend on the load applied to the engine 15. The speed sensor 25 generates a signal indicative of the rotational speed of the crankshaft 19. The governor arm 40 moves in response to the signal from the speed sensor 25. Movement of the governor arm 40 varies the flow of the air-fuel mixture to the combustion chamber 18 by causing movement of the linkage 50, which in turn moves the throttle lever 45 between the first and second positions.

The governor 30 compensates for an increased engine load, and a corresponding drop in engine speed, by moving the throttle member 45 toward the first position (shown in FIG. 5) to increase the speed of the engine 15. The primary spring 55 biases the throttle lever 45 toward the first position. The secondary spring 60 biases the throttle lever 45 toward the second position (shown in FIG. 8), at least partially opposing the primary force of the primary spring 55. As illustrated in FIGS. 5 and 8, when the throttle lever 45 is in the first position (FIG. 5), the primary spring 55 is stretched a smaller amount than it is when the throttle lever 45 is in the second position (FIG. 8). Thus, the primary spring 55 applies a larger biasing force when the throttle lever is in the second position than when the throttle lever 45 is in the first position. Conversely, the secondary spring 60 is stretched a greater amount when the throttle lever 45 is in the first position than when the throttle lever 45 is in the second position. Thus, the secondary spring 60 applies a greater biasing force when the throttle lever 45 is in the first position than when the throttle lever 45 is in the second position. The cooperation between the primary spring 55 and the secondary spring 60 limits the temporary droop or delay of the governor 30 in reaching the desired engine speed and generally stabilizes the engine 15 at the second engine speed.

The secondary spring 60 cooperates with the speed sensor 25 to move the throttle lever 45 toward the first position. The governor spring 55 counteracts the forces caused by the flyweights 31, the plunger 32, and the secondary spring 60, and tends to move the throttle lever toward the second position. More specifically, the flyweights 31 react to the speed of the engine 15, and move the plunger 32 accordingly. The speed of the engine 15 induces pivotal movement of the flyweights 31 due to a non-linear, centrifugal force. The flyweights 31 engage the plunger 32 to move the plunger 32, which engages the governor shaft 35 to move the governor arm 40.

At a low engine speed, the non-linear force of the flyweights 31 is relatively low, and the secondary force of the secondary spring 60 is relatively high. At a low engine speed, the relatively low non-linear force of the flyweights 31 counteracts a small portion of the primary force of the governor spring 55, and the relatively high secondary force of the secondary spring 60 counteracts a substantial portion of the relatively low primary force. At a high engine speed, the non-linear force of the flyweights 31 is relatively high, and the secondary force of the secondary spring 60 is relatively low. At a high engine speed, the relatively high non-linear force of the flyweights 31 counteracts a substantial portion of the primary force of the governor spring 55, and the small secondary force of the secondary spring 60 counteracts the remaining portion of the primary force of the governor spring 55.

Thus, at any engine speed the non-linear force induced by the flyweights 31 cooperates with the secondary force of the secondary spring 60 to counteract the primary force of the governor spring 55 to limit temporary droop of the engine 15. Due to the non-linear nature of the force induced by the flyweights 31, certain engine speeds may exist where the primary force of the governor spring 55 slightly overcomes the combined forces of the flyweights 31 and the secondary spring 60. Similarly, certain engine speeds may exist where the combined forces of the flyweights 31 and the secondary spring 60 slightly overcome the primary force of the governor spring 55.

At some engine speeds, the primary force of the primary spring 55 is balanced with or substantially equals the secondary force of the secondary spring 60. This balance increases the sensitivity of the governor 30 to changes in engine load. For example, when the throttle lever 45 is open (i.e., wide-open throttle), the primary force of the primary spring 55 is substantially equal to the secondary force of the secondary spring 60. At wide-open throttle, the governor 30 is increasingly sensitive to any change in engine load that affects engine speed, and quickly reacts to those changes. Any change in engine load will cause the governor 30 to vary the position of the throttle lever 45, and the increased sensitivity allows the springs 55, 60 to effectively stabilize the position of the throttle lever 45. In other embodiments, the engine 15 may include balancing the forces of the primary and secondary springs 55, 60 at throttle positions other than wide-open throttle (e.g., throttle lever open 90 percent, 80 percent, 75 percent, etc.).

When the engine 15 operates at a relatively constant speed and the primary and secondary forces are unbalanced, one of the primary spring 55 and the secondary spring 60 exerts a bias on the throttle lever 45 that is larger than the bias of the other of the primary and secondary springs 55, 60. The overall effect of the cooperating primary and secondary forces on the throttle lever 45 at the unbalanced positions biases the throttle lever 45 toward one of the first and second positions. For example, the primary force generated by the primary spring 55 decreases, and the secondary force generated by the secondary spring 60 increases as the throttle lever 45 moves toward the first or open position. Likewise, the primary force generated by the primary spring 55 increases, and the secondary force generated by the secondary spring 60 decreases when the throttle lever 45 moves toward the second or closed position.

In embodiments of the governor 30 that include the tertiary spring 95, the coefficient of friction between the linkage 50 and the tertiary spring 95 causes resistance to movement of the linkage 50. The bias of the governor spring 55, the secondary spring 60 and the dampening effect of the tertiary spring 95 cooperate to limit temporary droop of the engine 15.

Various features and advantages of the invention are set forth in the following claims.

What is claimed is:

1. A mechanical governor for an engine, the mechanical governor comprising:

a speed sensor coupled to the engine and movable in response to changes in a speed of the engine;

a throttle member movable between a first position and a second position;

a linkage operably connecting the speed sensor and the throttle member to move the throttle member between the first position and the second position in response to the speed of the engine;

a primary spring coupled between the throttle member and a first fixed portion of the engine to bias the throttle member in a first direction; and a secondary spring coupled between the throttle member and a second fixed portion of the engine to bias the throttle member in a second direction at least partially opposite to the first direction.

2. The governor of claim 1, wherein the secondary spring is selected such that the secondary spring produces a secondary force that substantially opposes a primary force produced by the primary spring when the throttle member is in the first position.

3. The governor of claim 1, wherein the secondary spring is spaced from the linkage and does not contact the linkage.

4. The governor of claim 1, wherein the bias of the secondary spring in the second direction is substantially opposite to the bias of the primary spring in the first direction.

5. The governor of claim 1, wherein the primary spring defines a primary spring rate and the secondary spring defines a secondary spring rate, and wherein the secondary spring rate is less than the primary spring rate.

6. The governor of claim 5, wherein the secondary spring rate is between about 90 percent and 99 percent of the primary spring rate.

7. The governor of claim 1, wherein the primary spring is disposed at a first oblique angle with respect to a first axis defined by the linkage, and wherein the secondary spring is disposed at a second oblique angle with respect to the first axis that is substantially equal to the first oblique angle.

8. The governor of claim 7, wherein each of the first oblique angle and the second oblique angle is disposed at about 20 degrees from the first axis.

9. The governor of claim 1, wherein the primary spring and the secondary spring are each disposed parallel to a first axis defined by the linkage.

10. The governor of claim 1, wherein the speed sensor includes flyweights to sense a speed of the engine, and wherein the linkage is movable in response to movement of the flyweights.

11. The governor of claim 1, further comprising a dampening member positioned adjacent the throttle member and engageable with the throttle member when the throttle member is in one of the first position and the second position.

12. An internal combustion engine comprising:

a cylinder;

a combustion chamber;

a piston disposed within the cylinder and reciprocal in response to combustion of a fuel in the combustion chamber;

a speed sensor coupled to the engine and operable to generate a signal corresponding to a speed of the engine;

a throttle member movable between a first position and a second position in response to the signal;

a primary spring coupled to the throttle member to bias the throttle member in a first direction, the primary spring defining a primary spring rate; and a secondary spring coupled to the throttle member to bias the throttle member in a second direction at least partially opposite to the first direction, the secondary spring defining a secondary spring rate that is less than the primary spring rate.

13. The engine of claim 12, wherein the secondary spring rate is between about 90 percent and 99 percent of the primary spring rate.

14. The engine of claim 12, wherein the secondary spring is selected such that the secondary spring produces a secondary force that substantially opposes a primary force produced by the primary spring when the throttle member is in the first position.

15. The engine of claim 12, further comprising a linkage interconnecting the speed sensor and the throttle member to move the throttle member between the first position and the second position in response to the speed of the engine.

16. The engine of claim 15, wherein the secondary spring is spaced from the linkage and does not contact the linkage.

17. The engine of claim 12, wherein the second direction is substantially opposite to the first direction.

18. The engine of claim 12, wherein the speed sensor includes flyweights to sense a speed of the engine and a governor arm that engages the linkage and movable in response to movement of the flyweights.

19. The engine of claim 12, wherein the primary spring is disposed at a first oblique angle with respect to a first axis defined by the linkage, and wherein the secondary spring is disposed at a second oblique angle with respect to the first axis that is substantially equal to the first oblique angle.

20. The engine of claim 12, wherein each of the first oblique angle and the second oblique angle is disposed less than about 20 degrees from the first axis.

21. The engine of claim 12, wherein the primary spring and the secondary spring are each disposed parallel to a first axis defined by the linkage.

22. The engine of claim 12, further comprising a dampening member positioned adjacent the throttle member and engageable with the throttle member when the throttle member is in one of the first position and the second position.

* * * * *